United States Patent [19]

Smith et al.

[11] 4,005,918

[45] Feb. 1, 1977

[54] VERTICALLY ADJUSTABLE SEWING MACHINE MOUNTING

[75] Inventors: James Smith; Arthur L. Van Ryn, both of Grand Rapids, Mich.

[73] Assignee: Smith Brothers Wood Products Inc., Grand Rapids, Mich.

[22] Filed: Sept. 15, 1975

[21] Appl. No.: 613,248

[52] U.S. Cl. ..... 312/27; 112/217.1; 312/30; 312/208

[51] Int. Cl.[2] ..... A47B 81/00; A47F 5/08

[58] Field of Search ..... 312/22, 23–29, 312/30, 272, 276, 208; 112/260, 258, 217.1

[56] References Cited

UNITED STATES PATENTS

| | | | |
|---|---|---|---|
| 408,553 | 8/1889 | Tyler | 312/22 |
| 418,522 | 12/1889 | Riefer | 312/27 |
| 3,788,716 | 1/1974 | Roberts et al. | 312/29 |
| 3,866,991 | 2/1975 | Wener | 312/29 |

*Primary Examiner*—Casmir A. Nunberg
*Attorney, Agent, or Firm*—Price, Heneveld, Huizenga & Cooper

[57] ABSTRACT

A mounting means in a storage cabinet for a free arm sewing machine is shiftable between a storage position, a first working position with the arm of the machine positioned flush with the top of the cabinet for conventional flat bed operation and a second working position wherein the free arm is positioned above the top of the cabinet for access. The mounting includes a pair of hinged members one of which is mounted for pivotal movement within the cabinet. In a first working position the members, folded together, are disposed within the cabinet parallel and below the top of the cabinet. In a second or free arm position, one member is flush with the top of the cabinet while the other is angularly disposed with respect thereto.

38 Claims, 14 Drawing Figures

VERTICALLY ADJUSTABLE SEWING MACHINE MOUNTING

BACKGROUND OF THE INVENTION

The present invention relates to mounting means in a storage cabinet for a sewing machine having an open, or as is commonly called, a free arm configuration. More particularly, the invention relates to a mounting means for the sewing machine wherein the mounting means and the machine carried thereon are positionable between a storage position, a first working position with the free arm flush with the top of the cabinet for flat bed use, and a second working position wherein the free arm is positoned above the top of the cabinet for access thereto.

The free arm on a free arm type sewing machine is typically used for sewing sleeves, trouser legs and the like where the arm is positioned inside the material to be sewn and the presser foot, the needle and like component parts carried on the head of the sewing machine are positioned exteriorly. When the machine is used in a conventional flat bed manner, it is desirable to have the top surface of the free arm, that is the portion of the arm on which the feed dog, the needle plate and shuttle cover are carried, positoned flush with the top of the cabinet such that a large expanse of flat work surface is provided.

In prior art assemblies, the machine and its mounting is shiftable between a storage position within the cabinet and a single working position generally with the free arm flush at the top of the cabinet. When access to the free arm is desired, a cover panel is removed from the top of the cabinet and the free arm is accessible from the top, although it is recessed below the planar top surface of the cabinet. Since the free arm is recessed, the material placed on the free arm is usually distorted, it must be folded or otherwise shifted about such that it will fit over the free arm. In other arrangements, the machine is completely removed from the cabinet and set on its base on top of the cabinet when it is used in the free arm mode. Other mounting mechanisms have also been developed wherein the machine is mounted on a vertically movable horizontal panel member fixed in tracks or the like for generally vertical movement within the cabinet, such that it is positionable between a storage and two working positions. Such vertically disposed mounting arrangements are, however, generally quite bulky, cumbersome to operate, and when in the storage position, the vertically mounted support occupies most of the interior of the cabinet. If the sewing machine cabinet is to be configured as, for example, a desk when the machine is in the storage position, the vertically mounted arrangement occupies most, if not all, of the knee room within the desk and it is difficult, if not impossible, to position a chair thereunder. Additionally, in a storage position, the machine, its mounting, the tracks and other mechanisms are usually visible thereunder destroying the aesthetic appearance of the cabinet.

Other mechanisms are also known in the art utilizing complicated linkages, springs and the like, but are costly in terms of parts, manufacturing cost and complexity of use.

There exists, therefore, a need for improved mounting means for a sewing machine within a cabinet, particularly a mounting for a sewing machine of the free arm type wherein the free arm can be conveniently and easily positioned above the top surface of the cabinet when required and which may additionally be easily shifted into a conventional flush mounted position and finally, which can be conveniently placed in a storage position without destroying the aesthetic appearance of the cabinet.

SUMMARY OF THE INVENTION

The sewing machine mounting of the present invention overcomes the difficulties of the prior art as mentioned above, in its provision of an improved mounting mechanism shiftable between a storage position and two working positions. In a first working position, the arm of the machine is positioned generally flush with the top of the cabinet for flat bed use and in a second working position, the free arm of the machine is positioned above the top of the cabinet for access thereto. Basically, the improved mounting means includes a first member mounted in the cabinet and pivotal between a first generally vertical storage position, a second generally horizontal position and a third position. Means is provided for holding the first member in the second and third positions. A second member forming a mounting surface of the sewing machine is hinged to the first member and is shiftable between a first position generally parallel to the first member and a second position angularly disposed with respect thereto. The second member, when positioned parallel to the first member when the first member is in its second position, supports the machine arm flush with the top of the cabinet. When shifted into its second position, the second member is angularly disposed with respect to the first member and supports the sewing machine mounted thereon above the cabinet top for direct, open access to the free arm.

The mounting means of the invention is also adapted for mounting within the opening of virtually any sewing machine cabinet, even those originally adapted to house only a flat bed sewing machine. Accordingly, upon replacement of a flat bed sewing machine with a free arm machine, it is not necessary to replace the entire cabinet.

The many additional objects and advantages of the present invention will become readily apparent to those skilled in the art from a consideration of the following detailed description of the preferred embodiment when read in conjunction with the accompanying drawings.

BRIEF DESCRITPION OF THE DRAWINGS

Figure 5:
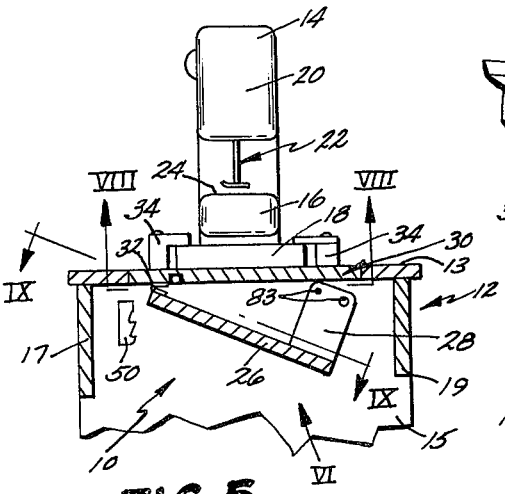
FIG. 5 is a cross-sectional view similar to FIG. 4 taken along the plane V—V of FIG. 1 illustrating the mounting means of the invention supporting the sewing machine in a free arm access position.
Figure 6:
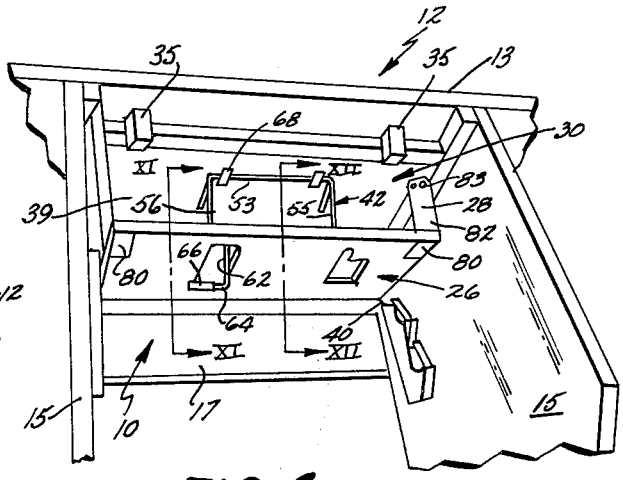
FIG. 6 is a perspective view looking upwardly from the back and bottom of the cabinet generally along the arrow designated VI in FIG. 5.
Figure 7:
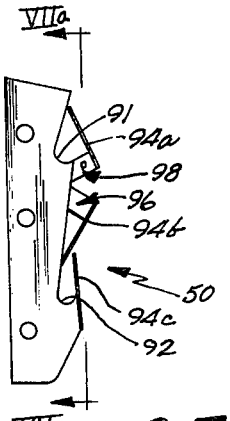
FIG. 7 is a front elevational view of a stepped supporting block mounted within the cabinet to hold the mounting means in its first and second positions.
Figure 8:
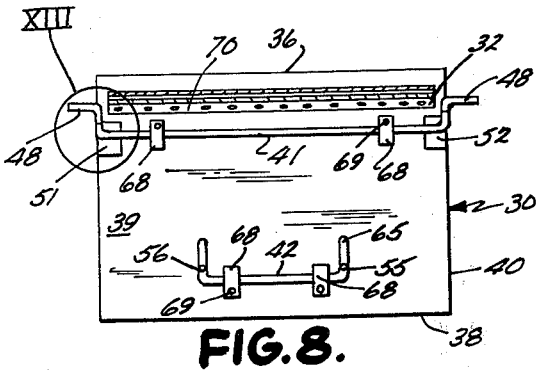
Figure 7A:
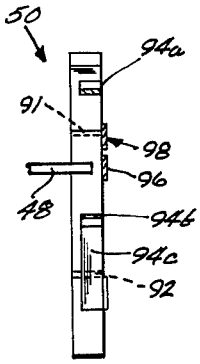
Figure 9:
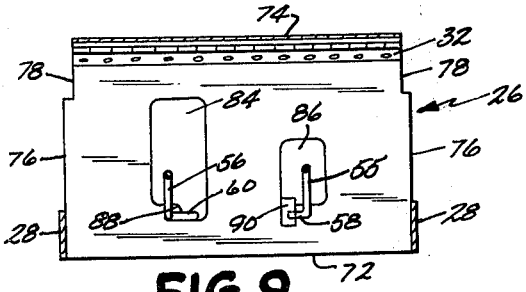
Figure 10:
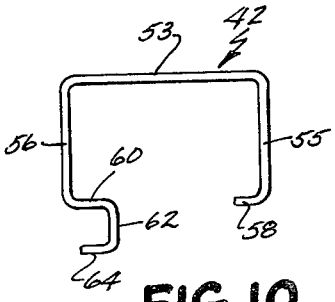
Figure 12:
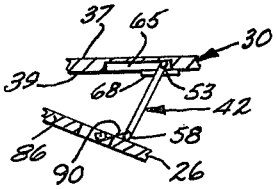
Figure 11:
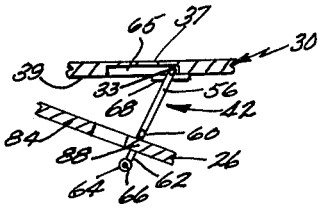

FIG. 7*a* is a side view taken along the plane VII*a*—VII*a* of FIG. 7;

FIG. 8 is a view of one of the mounting members taken generally along the line VIII—VIII of FIG. 5;

FIG. 9 is a plan view of the other of the mounting members taken along the plane IX—IX of FIG. 5;

FIG. 10 is a plan view of the linking member adapted to hold the first and second panel members in angularly disposed relationship;

FIG. 11 is a cross-sectional view taken along the plane XI—XI of FIG. 6;

FIG. 12 is a cross-sectional view taken along the plane XII—XII of FIG. 6; and

Figure 13:
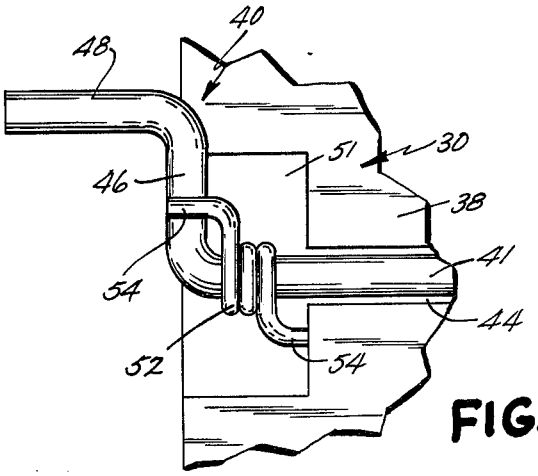

FIG. 13 is an enlarged view of the biasing mechanism shown in the circled area XIII of FIG. 8.

DESCRIPTION OF THE PREFERRED EMBODIMENT

Referring now to the drawings and in particular to FIGS. 1–5, the mounting means of the invention generally designated by the numeral 10 is shown positioned within a storage cabinet 12, or other suitable enclosure, to support a sewing machine 14 of the type having a "free arm" 16.

Free arm sewing machines are well known in the art and since the sewing machine itself forms no part of the invention, only those portions thereof necessary to an understanding of the invention will be described. A free arm sewing machine typically includes the previously mentioned free arm 16 which extends parallel to the base 18 of the machine. The free arm is spaced a slight distance upwardly from the base. The machine head 20 extends perpendicular to free arm 16 and carries the conventional needle, presser foot and like components 22. The top surface or bed 24 of free arm 16 carries the usual cooperating elements including the shuttle cover, needle plate and feed dog mechanism (not shown).

Figure 1:
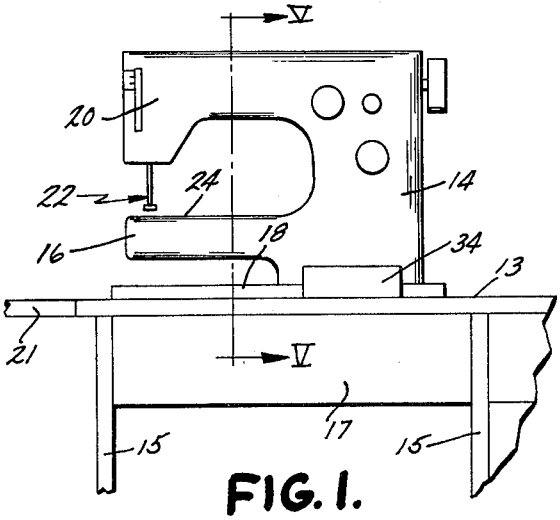
FIG. 1 is a fragmentary front elevational view illustrating a cabinet incorporating the invention with a sewing machine mounted thereon in a free arm access position.
Figure 2:
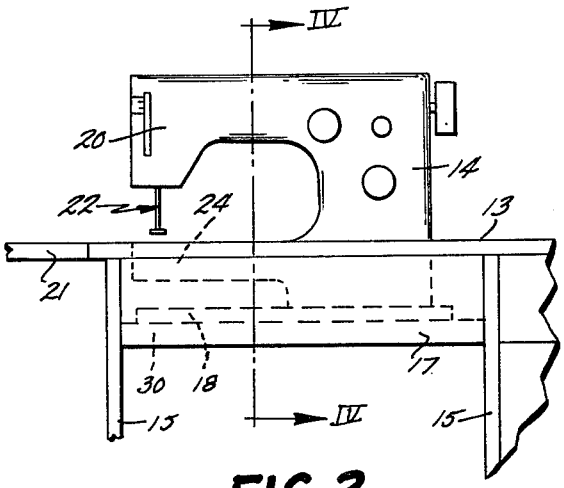
FIG. 2 is a front elevational view similar to FIG. 1 showing the sewing machine in a second or conventional flat bed position.

When operated in the free arm mode, as shown in FIG. 1, free arm 16 is positioned above the top of cabinet 12 for access thereto. When used in the conventional or flat bed mode, as shown in FIG. 2, the top surface 24 of the free arm is flush with the top surface 13 of the cabinet in which the machine is contained.

Figure 3:
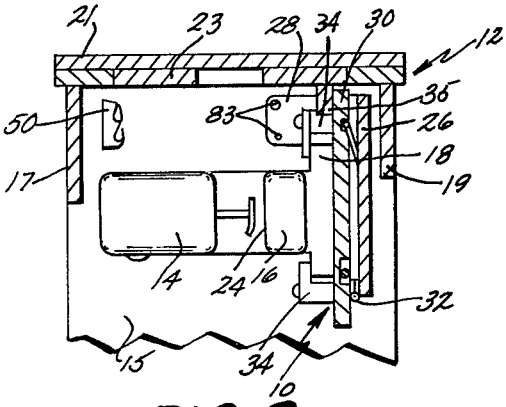
FIG. 3 is a fragmentary cross-sectional view of the cabinet incorporating the mounting means of the invention in a storage position.

The cabinet itself is of generally conventional construction and may be designed as a desk, table or like article of furniture. The cabinet includes top surface or panel 13 and a pair of side walls 15 forming a cabinet or desk housing having a generally open front and rear. A face panel 17 extending downwardly at the front as well as a corresponding panel 19 at the rear form the generally completed assembly. A cover member 21 is hinged to the top surface in a conventional manner to form an elongated work surface when open. Cover 21 may be folded over to close top surface 13 when the machine is in a storage position as shown in FIG. 3. When the machine is positioned for use in the conventional or flat bed mode (FIGS. 2 and 4), an insert panel 23, having cutout portions to accommodate the free arm and other parts of the machine, is fitted into an opening in the top of the cabinet through which the machine extends upwardly.

Mounting means 10, shown in greater detail in FIGS. 6 and 8–13, includes a first panel-like member 26 generally rectangular in configuration and adapted for pivotal mounting in the cabinet by means of a pair of bracket members 28. A second, also generally rectangular, panel 30 forms a mount for the sewing machine and is fixed to the first panel by means of an elongated hinge 32. The second panel carries a pair of mounting blocks 34 by which base 18 of sewing machine 14 is secured to the second panel for movement therewith.

Referring to FIGS. 8 and 10–13, the construction of the second, or mounting panel 30, is shown in greater detail. Mounting panel 30, as previously mentioned, is generally rectangular in configuration including a forward edge 36 (FIG. 8), a rear or free edge 38 and a pair of parallel side edges 40. One surface 37 (FIGS. 11 and 12) of the mounting panel carries the previously mentioned mounting blocks 34 and forms the mounting surface upon which the base 18 of the sewing machine is fixed. The opposite surface 39 (FIG. 8) of panel 30 is equipped with a pair of rod-like bracket elements including a retainer rod assembly 41 and a linking rod assembly 42. Retainer rod 41 is pivotally mounted on bottom surface 39 of panel 30 in a channel-like recess or groove 44 cut into surface 39 of the panel. The ends of retainer rod 41 are bent upwardly a slight distance forming a leg 46 (FIG. 13) and outwardly to form a pair of outwardly extending engaging arms 48. Arms 48 extend form sides 40 of the mounting panel for cooperative engagement with spaced steps formed in a retainer block 50 (FIG. 7) mounted on the side walls of the cabinet as will be more fully described hereinafter. Groove 40 is enlarged as indicated at 51 (FIGS. 8 and 13) at side edges 40 of the mounting panel to allow limited pivotal movement of retainer rod 41. A coil spring 52, positioned over rod 41, has a pair of outwardly extending legs 54. One of legs 54 engages panel 30 at the base of groove 51 while the other of the legs engages the bent leg portion 46 of retainer rod 41 to normally bias arm 48 toward the forward edge 36 of the panel.

Linking rod assembly 42 (FIG. 10) is generally U-shaped, having a base 53 and a pair of parallel legs 55 and 56 extending generally perpendicular to the base. One leg 55 has a foot 58 formed at one end extending inwardly and parallel to base 53. The other leg 56 has a similar foot 60 formed thereon extending inwardly toward foot 58. A second leg 62, extends from foot 60 and is bent outwardly to form an arm 64 extending generally parallel to foot 60 and base 53.

Linking rod assembly 42 is pivotally mounted in a groove 65 FIG. 8 formed in surface 39 adjacent edge 38. Linking rod 42 and retainer rod 41 are each held in position for pivotal movement within grooves 65 and 44 respectively, by spaced apart retaining members 68 which are held in place by screws 69. One side of hinge 32 is fixed to surface 39 of panel 30 between retainer rod 41 and forward edge 36 by a plurality of screws 70.

Referring again to FIG. 9, the first or pivoted panel member 26 is also generally rectangular in configuration having a back edge 72, a front edge 74 and a pair of parallel side edges 76. Side edges 76, extending from front edge 74 are stepped at 78 a slight distance to allow clearance for the pivotal movement of the arms 46 of retainer rod 41 when the panels are connected together by hinge 32. Hinge 32 is fixed to the pivoted panel 26 adjacent edge 74. Brackets 28 are fixed to the sides 76 adjacent back edge 72.

Brackets 28, as shown in FIG. 6, are generally L-shaped, the lower leg 80 thereof being secured to the lower surface of pivoted panel 26. The upper leg 82 of bracket 28 includes a pair of spaced apart mounting openings 83 (FIGS. 3–6) by which the bracket is pivotally mounted to the interior of the cabinet at side walls 15. Although a pair of mounting openings 83 are shown in each bracket 28, this is for manufacturing convenience, that is, brackets 28 are indentically formed and may be positioned on either the left or right hand side of panel 26. When mounted in the cabinet, however, the pivot point is arranged to be about the rear opening 83 on each side of the panel.

Panel 26 has a pair of openings 84 and 86 formed therethrough (FIGS. 6 and 9) to receive the ends 58 and 64 of the U-shaped linking rod assembly 42. Opening 84 is configured to include a stepped portion 88 toward back wall 72. Step 88 forms an abutment to engage with foot 60 of linking rod 42 when panels 26 and 30 are positioned in an angular relationship with respect to each other as shown in FIGS. 5 and 6 to hold the sewing machine in the free arm access position. This is shown additionally in FIG. 11 wherein when the panels 26 and 30 are angularly positioned with respect to each other, foot 60 rests on the top surface of panel 26 and leg 62 extends through opening 84 such that arm 64 is located below the lower surface of panel 26.

Opening 86 cooperates with leg 58 of U-shaped bracket 42 and, as shown in FIG. 12, when the panels are angularly disposed with respect to each other, foot 58 rests on the top surface of panel 26. A flat leaf spring 90 (FIGS. 9 and 12), secured to one of the edge walls of opening 86, extends upwardly through the panel and outwardly toward back edge 72. In the position shown in FIG. 12, spring 90 applies a biasing force on foot 58 retaining it in position on the top surface of panel 26 when the panels are angularly disposed. When the panels 26 and 30 are positioned parallel to each other in either the storage position or the flat bed position shown in FIGS. 3 and 4 respectively, linking rod assembly 42 pivots so that its arms 55 and 56 lie partially within groove 65 (FIG. 8) and foot 58 and foot 60 lie generally between the panels through openings 84 and 86. When panels 26 and 30 are brought together, a portion of leg 62 and arm 64 extend through panel 26. Arm 64 is equipped with an extension sleeve or collar 66 to prevent arm 64 from being drawn through opening 84 if, for example, one should attempt to increase the angular relationship between panels 26 and 30.

Figure 4:
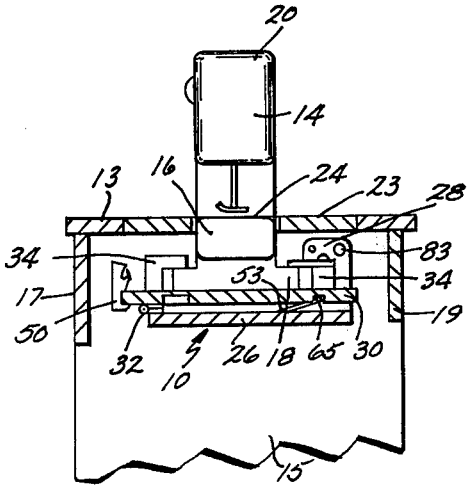
FIG. 4 is a fragmentary cross-sectional view taken generally along the plane IV—IV of FIG. 2 illustrating the mounting means of the invention positioning the machine in the flat bed position.

A pair of previously mentioned stepped retainer blocks 50 (FIG. 7) are disposed on opposite side walls 15 of cabinet 12 proximate the front portion thereof. Retainer blocks 50 are adapted for cooperative engagement with arms 48 formed on the ends of retainer rod 41 (FIG. 8), carried on mounting panel 30. Retainer blocks 50 are identical in configuration and include a pair of steps, a first or upper step 91 being adapted to hold mounting assembly 10 in its uppermost position, as shown in FIG. 5. A lower step 92 engages arms 48 to hold mounting assembly 10 in the lowermost position as illustrated in FIG. 4. At least one of the retainer blocks 50 is equipped with a plurality of leaf spring guide members **94*a*, 94*b* and 94*c* positioned to form an entrance and guide mechanism for guiding arms 48 of retainer rod 41 into the appropriate step 91 or 92 in the retainer block, as desired. Spring guides 94*b* and 94*c*, positioned for cooperative operation at lower step 92, are positioned with the free ends overlapping as shown in FIG. 7. Spring guide 94*c* is angularly disposed to form an upper entrance opening 96 to receive arm 48 on rod 41 as it moves downwardly into step 92. As arm 48 is shifted downwardly through entrance opening 96 and toward step 92, the free end of spring 94*b* and the upper facing portion of spring 94*c* are displaced outwardly to allow passage of arm 48 into step 92. With upward movement of panel 30, and the resultant upward movement of arm 48, spring 94*b* remains in position while the upper free end of spring 94*c* is flexed outwardly to allow arm 48 to withdraw from step 92. The free end of spring 94*b* simultaneously serves as a ramp to guide arm 48 upwardly and outwardly from step 92**.

Spring **94*a* similarly serves as a guide for arm 48 as the arm is positioned into step 91. The fixed lower end of spring 94*a* forms an entrance opening 98 to step 90 as the panel and arm 48 are moved upwardly together. It will be recalled that arm 48 is biased by spring 52 toward the end 36 of panel 30 to maintain arm 48 in an engaging position with respect to the springs 94*a*, 94*b* or 94*c* and steps 91 and 92 in retainer block 50, to hold the assembly in position. When it is desired to shift the mounting assembly into the storage position of FIG. 3, the assembly is simply raised or tilted toward the rear, causing arm 48 to slide along the upper portion of step 90, flexing the free end of spring 94*a* outwardly to thereby release the retaining rod arm 48 from its engaged position in retainer block 50. The assembly is then pivoted downwardly about the pivot bracket 28 and arm 48 follows along the outer surface of spring 94*a***.

With upward movement of the mounting assembly, the angular relationship between panels 26 and 30 is momentarily increased, allowing foot 58 to be released from the free end of spring 90 (at opening 86) and to move along the outer surface thereof in a ramp-like fashion. At the same time, foot 60 releases from abutment 88 thus allowing the panels to move together into the parallel position of FIG. 4 and finally into the storage position of FIG. 3.

OPERATION

While the operation of the invention should be readily understood from the preceding description, a brief summary of the operation of the invention with its movement from storage to a first working or flat bed position and a second working or free arm position will be briefly described. In a storage position, the apparatus of the invention is as illustrated in FIG. 3, that is, panels 26 and 30, connected together by hinge 32, are pivoted about pivot point 83 and rest inside the cabinet in a generally vertical orientation with the panels parallel to each other. To place the machine in a first working or flat bed position, as illustrated in FIG. 4, cover 21 is opened and insert panel 23 is removed such that access may be had to the upper portion of the sewing machine 14. Sewing machine 14 is then pivoted upwardly about pivot point 83, passing through the opening in the top surface of the cabinet, to the point where arm 48 of retainer rod 41 on panel 30 is raised slightly above the entrance opening 96 (FIG. 7) to the lower step 92 in retainer block 50. Bias spring 52, as it will be recalled, urges arm 48 of pivot rod 41 outwardly toward retainer block 50, to engage and ride upwardly along the outer surface of springs **94*c* and 94*b*** during the movement just described.

The machine is then tipped forward (to the left in FIGS. 3–5), whereupon arm 48 passes through entrance opening 96, pushing the free end of spring 94*b* outwardly to allow arm 48 to seat in step 92. The machine is then securely locked in place and in position for flat bed use as shown in FIG. 4. The insert panel 23 is replaced and the machine is ready for use.

When it is desired to position the sewing machine for free arm use as illustrated in FIG. 5, the top of the machine is grasped and momentarily pivoted foward, i.e., tipped to the left as illustrated in FIGS. 4 and 5, toward the face panel 17 of the cabinet, with panel 30 pivoting counterclockwise about hinge 32 and the legs 55 and 56 of linking rod 42, swinging counterclockwise by gravity toward the position shown in FIGS. 11 and 12. To fully reach this position, foot 58 is pulled upwardly through opening 86, flexing spring 90 aside, to ultimately rest on the top surface of panel 26. Simultaneously, foot 60 is pulled upwardly through opening 84 in panel 26 and comes to rest upon step 88 on the top surface of panel 26. The machine is then rocked slightly backward (to the right), pivoting about point 83 with the two panels held in the aforementioned angular relationship. As the machine is thus tilted backward, arms 48 move upwardly out of the bottom step 92 and enter the entrance opening 98 to the top step 91. As the machine is then lowered toward the front again, arms 48 seat in step 91 and the machine is positioned as shown in FIG. 5.

To return the machine for use in a conventional manner as shown in FIG. 4 or into a storage position, the top of the machine is first pulled forward to pivot it to the left, thereby moving the linking rod assembly 42 out of the position shown in FIGS. 11 and 12, that is, foot 58 and foot 60 are moved upward out of their abutting relationship with the top of panel 26. In so doing, the top of foot 58 first contacts that portion of the underside of spring 90 lying above panel 26, whereupon continued pivoting of the machine and its panel 30 causes foot 58 to flex the spring upwardly, ultimately allowing the foot to pass by the end of the spring. When this occurs, the spring returns to its normal flat position, wherein it lies below foot 58. If such foot is then lowered, by pivoting the top of the machine toward the rear of the cabinet, foot 58 will initially contact the top of spring 90 and then slide down the latter, thereby causing the linking rod assembly 42 to pivot clockwise about its central portion 53, with the stiffly resilient spring 90 then acting as an inclined ramp or cam. During this pivotal movement of the upper panel 30 toward the lower panel 26, the feet 58 and 60, and at least part of the leg 62, move downwardly into the openings 84 and 86 of panel 26, and the panels 26 and 30 move together into their generally parallel position as the machine is tipped further back.

At this time, however, the sewing machine will be angularly disposed within the cabinet and tipped toward the back, i.e., to the right of the cabinet from the position shown in FIGS. 4 and 5. From this position, with the panels in their mutually parallel but angularly tipped position, the machine is tipped slightly further backward, both panels pivoting about pivot point 83 and causing arm 48 to be lifted out of step 91, flexing the free end of spring 94*a* until arm 48 slips past the spring. As the machine is then tipped forwardly again, arm 48 rides downward along the outer surface of spring 94*a*, with spring 52 yielding sufficiently to allow the required rotation of retainer rod 41 to permit such travel of its end arms 48. When the arms 48 have ridden downwardly along the length of spring 94*a*, the coil spring 52 will (depending upon its spring force and the speed with which the machine and panels are pivoted downwardly) cause the arms 48 to spring outward as they clear the lower end of spring 94*a*, whereupon the arms 48 will enter the opening 96, and move onto the lower step 92, in a stepwise movement. Pivoting of the machine clockwise once again (i.e., toward the rear of the cabinet) about pivot point 83 will raise the arms 48 out of the lower step 92, flexing spring 94*c* outward, as in the elevating progression described above (which may, of course, ensue if it is instead desired to raise the machine to its free arm position). However, if it is desired to lower the machine to its storage position shown in FIG. 3, the machine is pivoted in the opposite direction (i.e., counterclockwise) after the arms 48 escape from spring 94*c*, rather than continuing to raise the machine, whereupon the arms 48 will ride downward along the outside of spring 94*c*, allowing full pivotal movement of the sewing machine and both panels 26 and 30 into the storage position shown, in which the rear edge of both panels pivot behind a pair of fixed retaining blocks 35 (FIGS. 3, 4 and 6) which hold the panels and the sewing machine in position by preventing the machine and panel 30 from pivoting counterclockwise away from panel 26 and out of the stored positions, toward the front of the cabinet.

As will be understood, each movement of the machine and panels causing arms 48 to flex and escape beyond one of the leaf springs 94*a*, 94*b*, or 94*c*, or causing the analogous operation of foot 58 and leaf spring 90, will be accompanied by an audible and touch-detectable "click" or other detent sound and feeling, thereby clearly signalling the operator of the event. Since the overall operation of the apparatus is basically a step-wise opposing-direction pivotal or rocking motion, accompanied by positive support at the points of arrestment in the steps 91 and 92 and by contact of the feet 58 and 60 upon the top of panel 26, together with the clicks or detents just mentioned, operation is easily learned and very convenient in actual use.

From the above description and drawings, those skilled in the art will recognize the many advantages of the present invention. While the apparatus has been described in connection with the mounting for a free arm sewing machine within a cabinet, other useful applications of the invention will occur to those skilled in the art. Through the use of the invention, an improved mounting means for a sewing machine within a cabinet is provided, particularly for a machine of the free arm type, which can be conveniently and easily positioned above the top surface of the cabinet and which, additionally, may be easily shifted into a conventional, flush mounted position to operate as a flat bed sewing machine. Finally, the machine can be conveniently placed in a storage position with a minimum of effort. Other modifications can be made to the novel mounting means of the present invention and it is intended that the equivalent arrangements be included unless the following claims by their wording expressly state otherwise.

The embodiments of the invention in which an exclusive property or privilege is claimed are defined as follows:

1. In a storage cabinet having means for mounting a sewing machine for positioning between working positions and a storage position the improvement comprising: said mounting means being shiftable from a sewing machine storage position to first and second sewing machine working positions, said mounting means including: a first member positionable at a first elevational position relative to the top surface of the cabinet and a second position below the top surface of the cabinet; said first member being disposed substantially parallel to said cabinet top surface in both such positions and sufficiently close to such surface to dispose at least the upper portion of a sewing machine carried on said member above the said surface in both of said first and second positions, a second member hingedly affixed to said first member; means pivotally mounting said second member in said cabinet, said second member being pivotal between a first generally vertical position, a second position relatively parallel to said first member when said first member is in said second position, and a third position angularly disposed with respect to said first member when said first member is in said first position; and means associated with said first and second members for releasably retaining said first and second members in their said respective first and second positions.

2. The improvement of claim 1 and further comprising said retaining means including interengageable means on at least one of said first and said second members, and on said cabinet, for holding said second member in said first and said second positions.

3. The improvement of claim 2 wherein said interengageable means is on said second member.

4. The improvement of claim 2 and further including support means on at last one of said first and said second members for supporting said first and said second members in said angularly disposed relationship.

5. The improvement of claim 4 wherein said support means includes a linking member hingedly supported on said first member; cooperative abutment means on said linking member and on said second member adapted to hold said first and said second members in said angularly disposed relationship; and locking means operatively associated with said abutment means to retain the latter in said first and second member-holding relationship.

6. The improvement of claim 2 wherein said retaining means includes an arm extending outwardly from one of said first and second members and an arm-receiving structure on said cabinet adapted to receive said arm, said receiving structure having a plurality of stepped recesses formed therein selectively engageable with said arm for holding said one member in said first and said second working positions.

7. The improvement of claim 6 and further including means acting on said arm for guiding said arm into engagement with said receiving structure.

8. The improvement of claim 7, wherein said means acting on said arm includes at least one resiliently deformable

9. In a storage cabinet for sewing machines of the type having a free arm and means for mounting the sewing machine for positioning between a storage position, a first working position with the top of the free arm generally flush with the top of the cabinet, and a free arm access position above the first working position, the improvement comprising; a first member mounted in said cabinet and pivotal between a first generally vertical storage position, a second generally horizontal position and a third position; releasable means for holding said first member in at least said second and said third positions; a second member hinged to said first member, said second member being shiftable between at least a first position and a second position angularly disposed with respect to said first member; said first member being adapted to support a sewing machine; said second member, when in its said first position cooperating with said first member to position the free arm of a sewing machine supported by said first member generally flush with the top of the cabinet, said second member, when shifted into said second position being angularly disposed with respect to said first member and cooperating therewith to elevate a sewing machine supported thereby above the top of the cabinet for access to said free arm.

10. The improvement of claim 9 and including retaining means for retaining said first member in its said second and third positions, said retaining means including engaging means on one of said first and said second members and on said cabinet for holding said second member in its said first and said second positions.

11. The improvement of claim 10 wherein said engaging means is on said second member.

12. The improvement of claim 9 and including support means on said first and said second members for supporting said first member upon the second member in said angularly disposed relationship.

13. The improvement of claim 12 wherein said support means includes a linking element supported on said first member; and cooperative abutment means on said linking element and on said second member adapted to mutually engage and thereby hold said first and said second members in said angularly disposed relationship.

14. The improvement of claim 10 wherein said retaining means includes an arm extending outwardly from one of said first and second members and a receiving structure on said cabinet adapted to receive said arm, said receiving structure having a plurality of stepped recesses formed therein selectively engageable with said arm for holding said second member in said first and said second working positions.

15. The improvement of claim 14 and further including biasing means acting upon said arm for biasing said arm into engagement with said receiving structure.

16. The improvement of claim 14, wherein said receiving structure includes guide means for at least partially shielding said stepped recesses and defining a restricted entry thereto located at particular relative positions.

17. The improvement of claim 16, wherein said guide means include elongate surfaces disposed for following contact by said outwardly-extending arm upon movement thereof relative to said receiving structure.

18. The improvement of claim 17, wherein said guide means define at least one entry opening to said stepped recesses for said arm at a position at a different level than that at which such recess supports the arm when contacted thereby.

19. The improvement of claim 17, wherein said guide means define at least one exit path from said stepped recesses for said arm at a position at a different level than that at which such recess supports the arm when contacted thereby.

20. The improvement of claim 18, wherein said guide means defining said entry opening further defines an exit path for said arm which is positioned at a different level than that of such entry opening.

21. The improvement of claim 16, wherein said guide means include at least one resilient member which is flexed by said arm upon a predetermined degree of forcible engagement therebetween.

22. The improvement of claim 21, wherein said resilient member comprises a leaf-type spring.

23. The improvement of claim 21, wherein said resilient member includes elongate surfaces disposed for following contact by said outwardly-extending arm upon movement thereof relative to said receiving structure.

24. The improvement of claim 23, wherein said guide means define at least one exit path from said stepped recesses for said arm at a position at a different level than that at which such recess supports the arm when contacted thereby.

25. The improvement of claim 24, wherein said different level of said one exit path is higher than the entry opening for the affected stepped recess.

26. The improvement of claim 25, wherein said guide means resilient member is mounted and disposed so as to be flexed by said arm as the latter is moved along and outwardly through said exit path, and so that such member blocks reverse entry by said arm through said exit path once said arm has exited therefrom.

27. The improvement of claim 13, wherein said linking element is swingably carried on said first member so as to be movable by gravity relative thereto as a function of positioning relative to the vertical, and wherein said element has a depending extremity forming the said cooperative abutment means on said linking member.

28. The improvement of claim 27, wherein said cooperative abutment means on said second member comprises a contact area on the surface thereof adapted to engage said depending extremity of said linking element.

29. The improvement of claim 28, and including means for guiding said depending extremity of said linking element to and from said contact area on said second member.

30. The improvement of claim 29, wherein said means for guiding said depending extremity guides the latter to and from said contact area along different paths.

31. The improvement of claim 30, and including releasable means for maintaining said depending extremity of said linking element in engagement with said contact area on the surface of said second member.

32. The improvement of claim 31, wherein said releasable means comprises a resilient portion of said means for guiding said depending extremity.

33. The improvement of claim 28, and including means for maintaining said depending extremity of said linking element in engagement with said contact area on the surface of said second member.

34. The improvement of claim 33, wherein said contact area on said second member is disposed adjacent a recess defined by such member for receiving said depending extremity of said linking element, and wherein said means for maintaining engagement comprises means for restricting entry of said depending extremity into said recess.

35. The improvement of claim 32, wherein said means for maintaining engagement comprises a resiliently-biased member.

36. The improvement of claim 9, wherein said first and second members comprise a pair of generally planar shelf members disposed generally in side-by-side relation one above the other and hinged together along a side edge of one to the other so as to be rotatable through acute angles of separation relative each other, said releasable holding means comprising supports for holding said shelf members in at least two positions of different acute angularity relative each other corresponding to said second and third positions of said first member.

37. The improvement of claim 36, wherein said supports are arranged to hold the upper shelf member in generally horizontal disposition in each of said two positions of different relative shelf angularity.

38. The improvement of claim 37, wherein said supports are arranged to hold the lower such shelf member in generally horizontal disposition in one of said two positions of different relative shelf angularity.

* * * * *

UNITED STATES PATENT AND TRADEMARK OFFICE

CERTIFICATE OF CORRECTION

PATENT NO. : 4,005,918

DATED : February 1, 1977

INVENTOR(S) : James Smith, Arthur L. Van Ryn

It is certified that error appears in the above-identified patent and that said Letters Patent are hereby corrected as shown below:

Column 1, line 26:

"positoned" should be --- positioned ---;

Column 2, line 24:

"of" should be --- for ---;

Column 4, line 29:

"form" should be --- from ---;

Column 5, line 50:

After "of" insert --- the ---;

Column 8, line 41:

"clicks" should be --- "clicks" ---;

UNITED STATES PATENT OFFICE

CERTIFICATE OF CORRECTION

Patent No. 4,005,918 Dated February 1, 1977

Inventor(s) James Smith, Arthur L. Van Ryn Page 2 of 2

It is certified that error appears in the above-identified patent and that said Letters Patent are hereby corrected as shown below:

Column 9, line 58:

After "deformable" insert -- element. --.

Signed and Sealed this

Thirty-first Day of May 1977

[SEAL]

*Attest:*

RUTH C. MASON
*Attesting Officer*

C. MARSHALL DANN
*Commissioner of Patents and Trademarks*